US006126556A

United States Patent [19]

Hsieh

[11] Patent Number: 6,126,556

[45] Date of Patent: Oct. 3, 2000

[54] GOLF CLUB HEAD

[76] Inventor: Wen-Liang Hsieh, No. 312 Chung Cheng Road, Mi Ching Village, Mi To Hsiang, Kaohsiung Hsien, Taiwan

[21] Appl. No.: 09/285,450

[22] Filed: Apr. 2, 1999

[51] Int. Cl.[7] ..... A63B 53/04

[52] U.S. Cl. ..... 473/256; 473/334; 473/338; 473/342; 473/349; 473/340

[58] Field of Search ..... 473/324, 325, 473/334, 335, 336, 337, 338, 339, 340, 341, 342, 349, 350, 256, 288, 291, 305–319, 251, 242, 219, 226, 227, 332, 333, 329

[56] References Cited

U.S. PATENT DOCUMENTS 2,332,342 10/1943 Reach .
4,085,934 4/1978 Churchward .
4,795,159 1/1989 Nagamoto .
5,154,424 10/1992 Lo .
5,253,869 10/1993 Dingle .
5,501,459 3/1996 Endo .
5,782,706 7/1998 Depriest .
5,971,867 10/1999 Galy .
5,976,033 11/1999 Takeda .
6,062,988 5/2000 Yamamoto .

*Primary Examiner*—Sebastiano Passaniti
*Attorney, Agent, or Firm*—Bacon & Thomas, PLLC

[57] ABSTRACT

A golf club head mainly comprises a body member having a neck portion adapted to receive a shaft; a faceplate disposed in the face section of the body member, the faceplate having at least a fastening rod extending therefrom; and at least a balancing weight body disposed between the body member and the faceplate. The balancing weight body having a slot which the fastening rod of the faceplate is inserted therethrough and is secured by a fastener, wherein the faceplate and the balancing weight body are integrally formed with the body member.

8 Claims, 8 Drawing Sheets

GOLF CLUB HEAD

BACKGROUND OF THE INVENTION

1. Field of the Invention

This invention relates generally to a golf club head, and specifically relates to an integrally formed golf club head.

2. Description of the Related Art

FIG. 1 illustrate a conventional golf club head including a recess 10 defined in the face section thereof for fittingly receiving a balancing weight body 12 and a striking faceplate 14. The bottom of the recess 10 is slightly larger than the opening thereof. The side portion of the balancing weight body 12 and the striking faceplate 14 are beveled and are inserted into the recess 10 by the punch of a press machine. In this way of combination, the balancing weight body 12 and the striking faceplate 14 are just inlaid in the golf club head. Therefore, after a long term use, they may be loosened from the recess 10 under vibration and thus adversely affect the hitting accuracy or sometimes even disengage with the recess 10, which, in turn, may hit other people and thus cause accidents.

Accordingly, the present invention is intended to provide a conventional golf club that mitigates and/or obviates the above problems.

SUMMARY OF THE INVENTION

It is a primary object of the present invention to provide a golf club head having a faceplate and at least a balancing weight body, wherein the faceplate and the balancing weight body are integrally formed within the golf club head, thereby reducing the possibility of disengagement.

In accordance with the present invention, the golf club head mainly comprises a body member having a neck portion adapted to receive a shaft; a faceplate disposed in the face section of the body member, the faceplate having at least a fastening rod extending therefrom; and at least a balancing weight body disposed between the body member and the faceplate. The balancing weight body having a slot which the fastening rod of the faceplate is inserted therethrough and is secured by a fastener, wherein the faceplate and the balancing weight body are integrally formed with the body member.

When manufacturing the gulf club head of the present invention, the faceplate is assembled with the balancing weight body, then the assembled unit is put into an appropriate mold, depending on the desired configuration of the golf club head, and finally, molten metal is poured into the mold to obtain the molded product. Accordingly, the molten metal can flow into the slot of the balancing weight body during the molding process such that the assembled faceplate and balancing weight body can be integrally secured to the body member, thereby reducing the possibility of disengagement. In addition, the color of the faceplate and/or the balancing weight body can be displayed on the surface of the body member, thereby creating the visual variety in color decoration.

DETAILED DESCRIPTION OF THE PREFERRED EMBODIMENT

Figure 1:
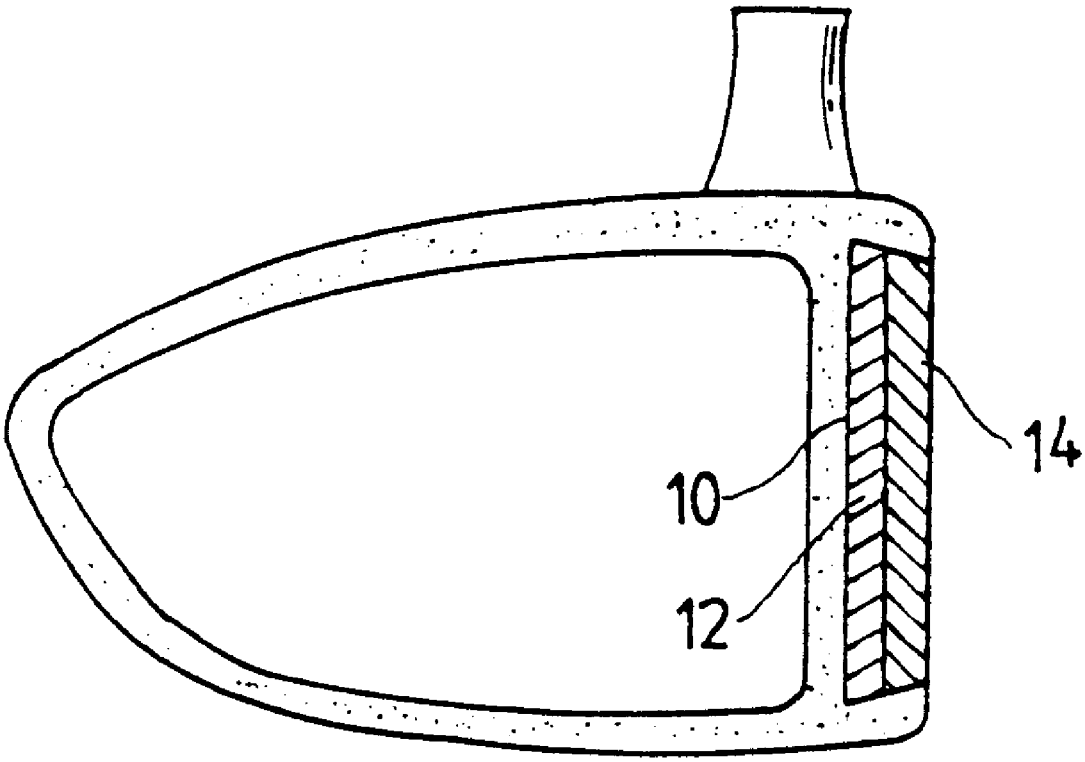
PRIOR ART FIG.1
FIG. 1 is a partial sectional view according to a conventional gulf club head.
Figure 2:
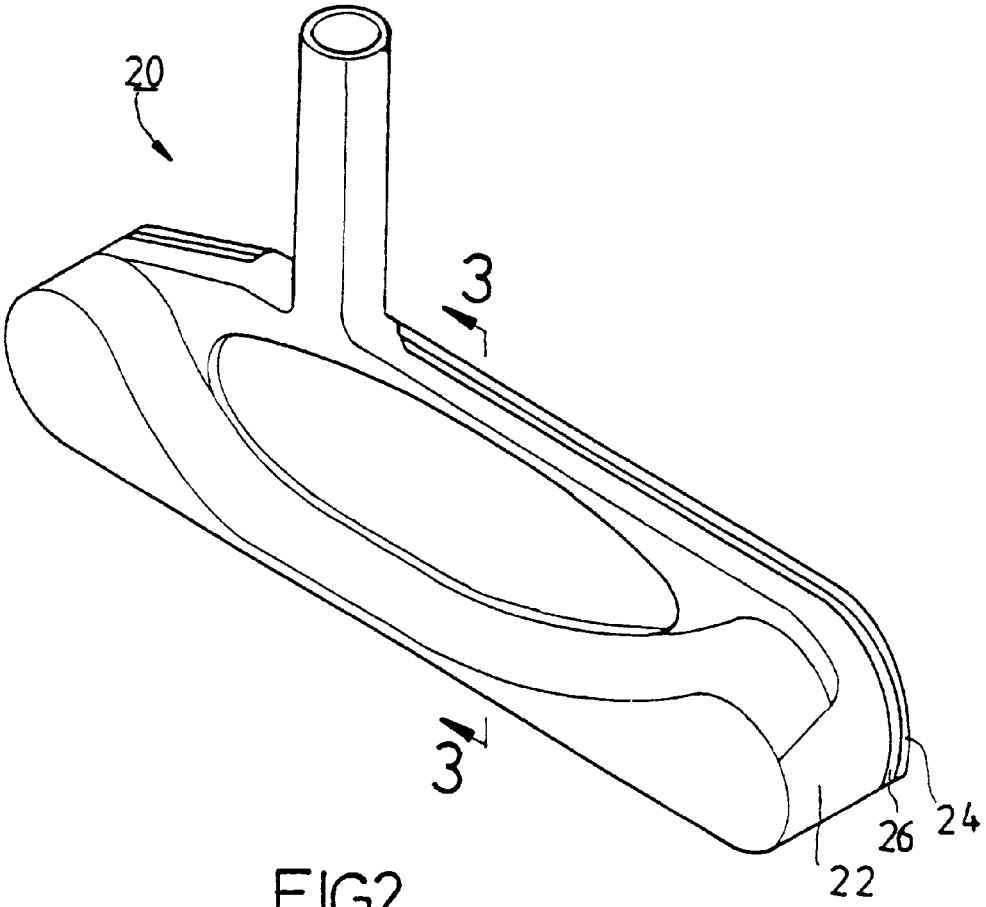
FIG. 2 is a perspective view of a first embodiment of the present invention.
Figure 3:
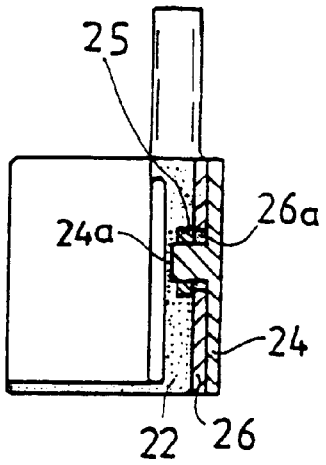
FIG. 3 is a partial sectional view along line 3—3 in FIG. 2.
Figure 4:
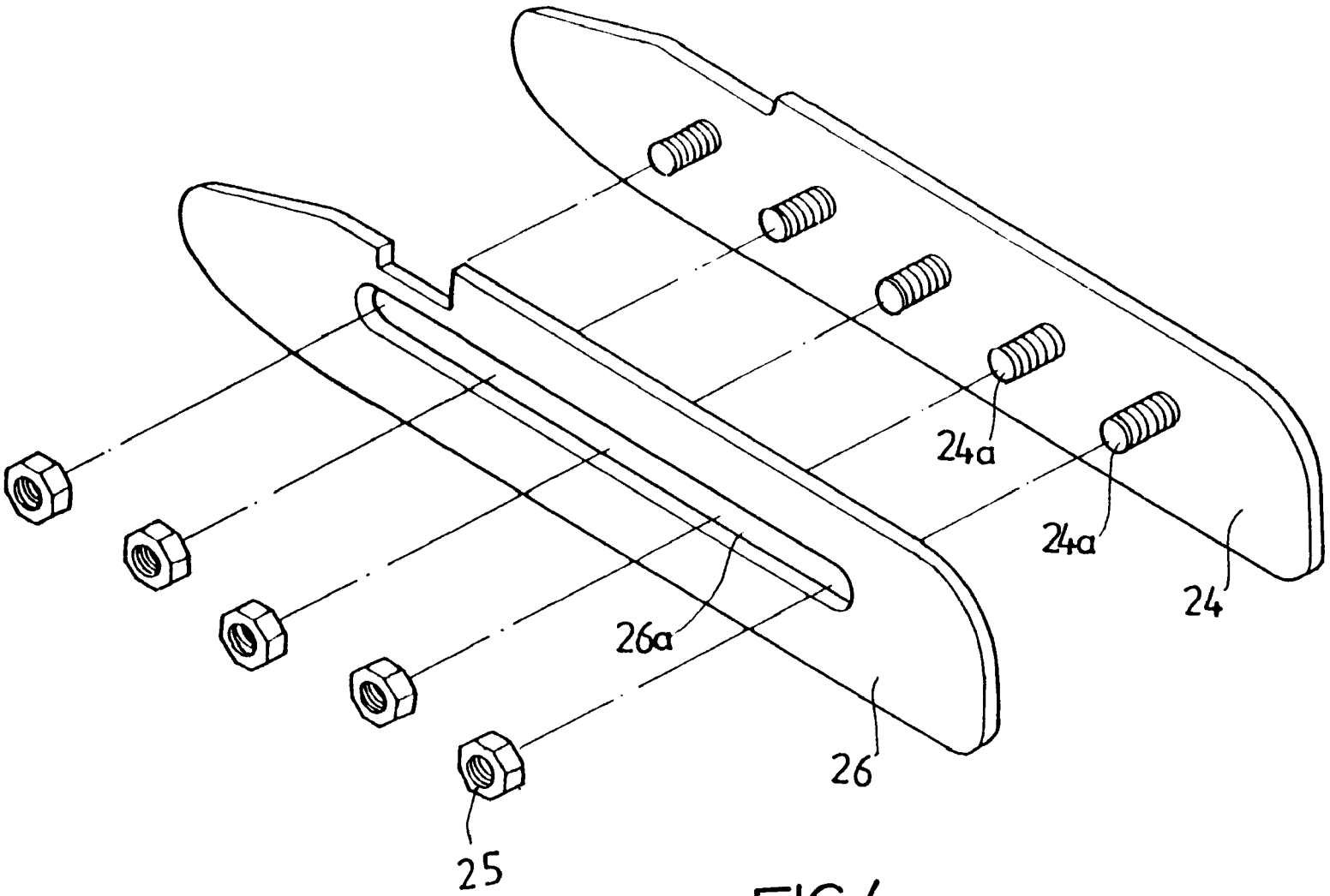
FIG. 4 is a perspective view showing the striking faceplate and the balancing weight body of the first embodiment of the present invention.

FIG. 2 and FIG. 3 illustrate various views of a putter gulf club head 20 according to a first embodiment of the present invention which generally comprises a body member 22, a striking faceplate 24 having at least a fastening rod such as a bolt 24*a* extending outwardly therefrom, at least a fastener such as a nut 25 and at least a balancing weight body 26 having a slot 26*a* (referring to FIG. 4) defined therein. The striking faceplate 24 is disposed in the face section of the body member 22 and the balancing weight body 26 is disposed between the body member 22 and the striking faceplate 24. The bolt 24*a* of the striking faceplate 24 extends through the slot 26*a* which, in turn, is secured by the nut 25 such that the balancing weight body 26 and the striking faceplate 24 can be joined together. It should be understood that the bolt 24*a* and nut 25 of this invention is intended only as an example and not as a restriction or limitation. Other fastening means for securing the balancing weight body 26 and the striking faceplate 24 can be employed by the present invention.

The method for manufacturing the putter gulf club head 20 according to the first embodiment of the present invention comprises the steps of (a) assembling the balancing weight body 26 and the striking faceplate 24 by fastening the nut 25 on the bolt 24*a* extending through the slot 26*a*; (b) placing the assembled striking faceplate 24 and balancing weight body 26 into a mold assembly having a contour complementary to that of the putter gulf club head 20; (c) pouring molten metal such as alloy of titanium, aluminum or Maraging steel into molds to obtain the molded gulf club head 20. During the molding process, the molten metal can flow into the slot 26*a* of the balancing weight body 26; hence, after cooling, the metal can fill the slot 26*a* and jam between the nut 25 and the striking faceplate 24 (referring to FIG. 3) such that the assembled striking faceplate 24 and balancing weight body 26 can be integrally secured to the body member 22. The body member 22 is then assembled with a shaft at its neck portion to form a golf club.

Figure 5:
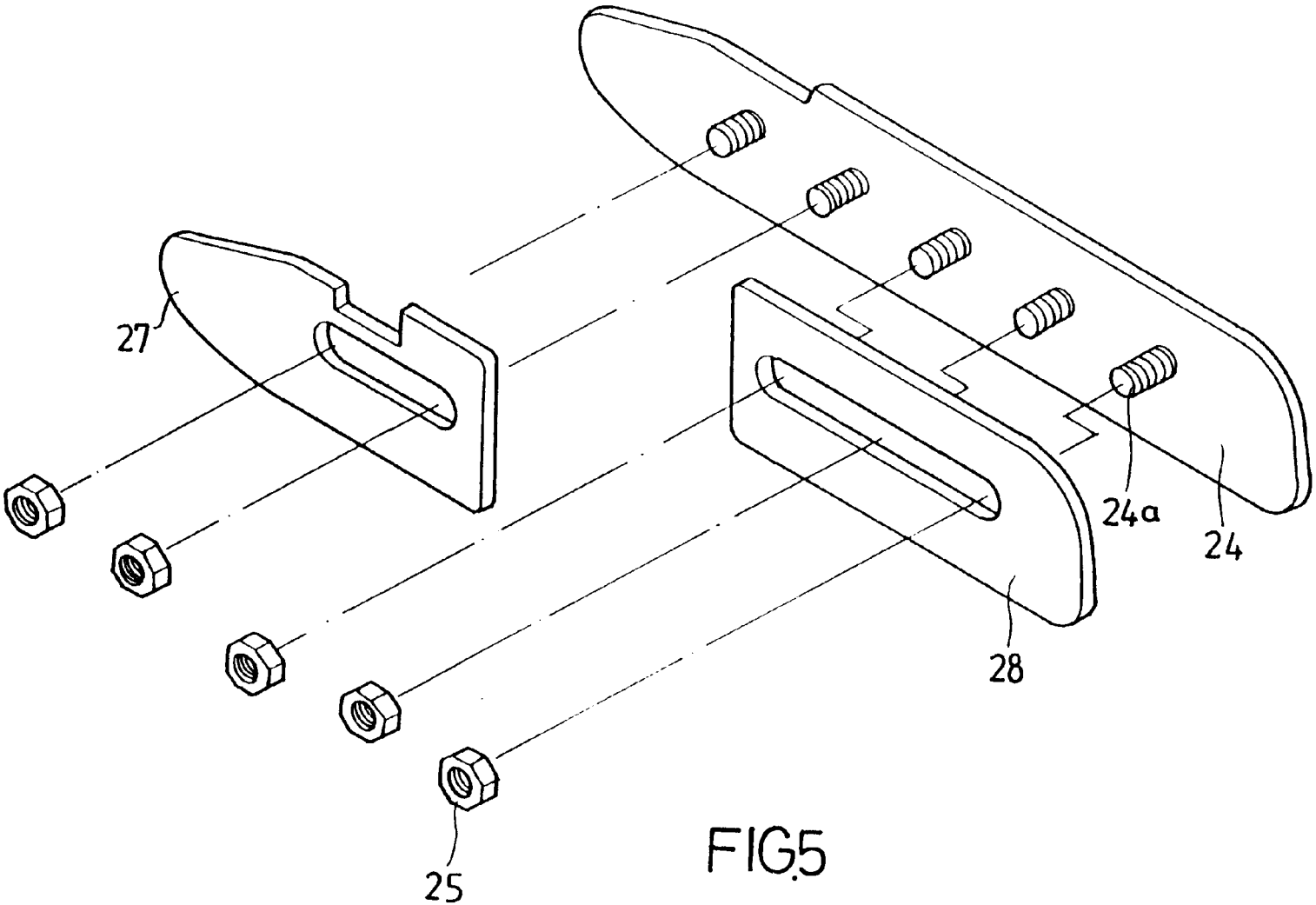
FIG. 5 is a perspective view showing the other striking faceplate and balancing weight body of the first embodiment of the present invention.

FIG. 5 illustrates another embodiment having two balancing weight bodies 27, 28 in accordance with the present invention. The number of the balancing weight bodies could be varied depending on the practical need. In addition, the number, weight, position of the nuts 25 could be varied depending on the practical need in order to adjust the center of mass of the gulf club head 20. For example, but not a limitation to the present invention, the center of mass can be positioned nearer the side end of the golf club head by applying only two of the nuts 25 to the bolts 24*a* nearby the side of the striking plate 24.

It will be understood that the striking faceplate and the balancing weight body can be designed as various shape such as squareness, roundness or diamond only as long as that matches the overall shape of the molded golf club head. In addition, the balancing weight body 26 can be made of various alloy such as nickel, cobalt, bismuth and cadmium to meet different requirements. Further, the fastener can also be made of different alloy to adjust the center of mass of the golf club head 20.

Figure 6:
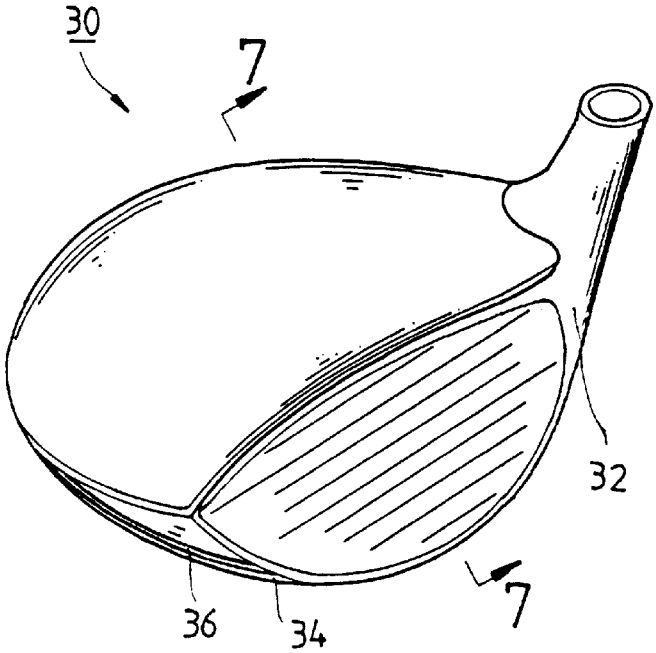
FIG. 6 is a perspective view of a second embodiment of the present invention.
Figure 7:
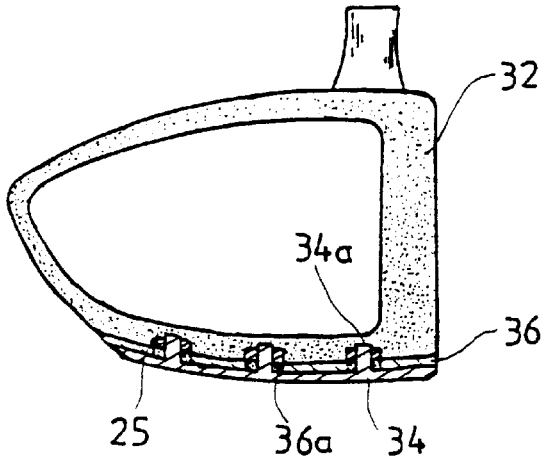
FIG. 7 is a partial sectional view along line 7—7 in FIG. 6.
Figure 8:
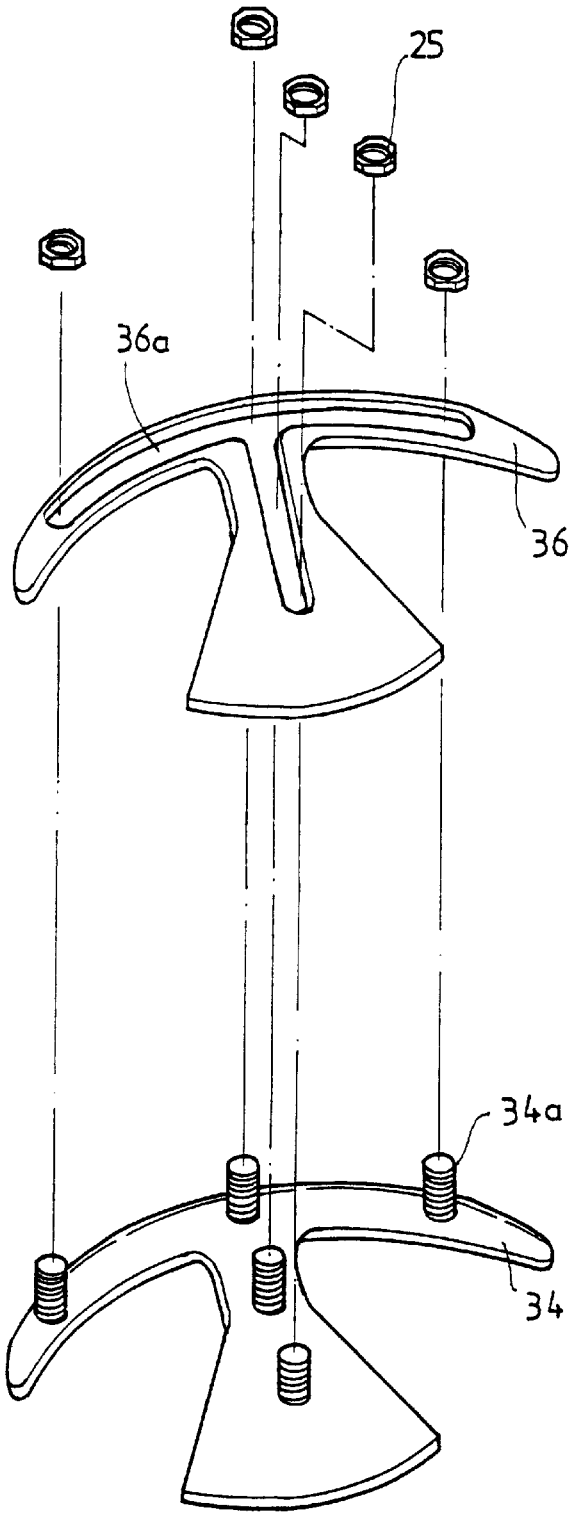
FIG. 8 is a perspective view showing the striking faceplate and the balancing weight body of the second embodiment of the present invention.

FIG. 6 and FIG. 7 illustrate various views of a wood gulf club head 30 according to the second embodiment of the present invention which generally comprises a body member 32, a decorative plate 34 having at least a fastening rod such as bolt 34*a* extending outwardly therefrom, at least a fastener such as nut 25 and at least a balancing weight body 36 having a slot 36*a* (referring to FIG. 8) defined therein. The decorative plate 34 is disposed in the sole section of the body member 32, and the balancing weight body 36 is disposed between the body member 33 and the decorative plate 34. The bolt 34*a* of the decorative plate 34 extends through the slot 36*a* which, in turn, is fastened by the nut 25 such that the balancing weight body 36 and the decorative plate 34 can be joined together.

The procedure for manufacturing the wood gulf club head 30 according to the second embodiment of the present invention is similar to that of the putter gulf club head 20 except the wood gulf club head 30 is first separately molded into at least two parts and then assembled together. During the molding process, the molten metal can flow into the slot 36*a* of the balancing weight body 36; hence, after cooling, the metal can fill the slot 36*a* and jam between the nut 25 and the decorative plate 34 (referring to FIG. 3) such that the assembled decorative plate 34 and balancing weight body 26 can be integrally secured to the body member 32. The body member 32 is then assembled with a shaft at its neck portion to form a wood golf club.

Figure 9:
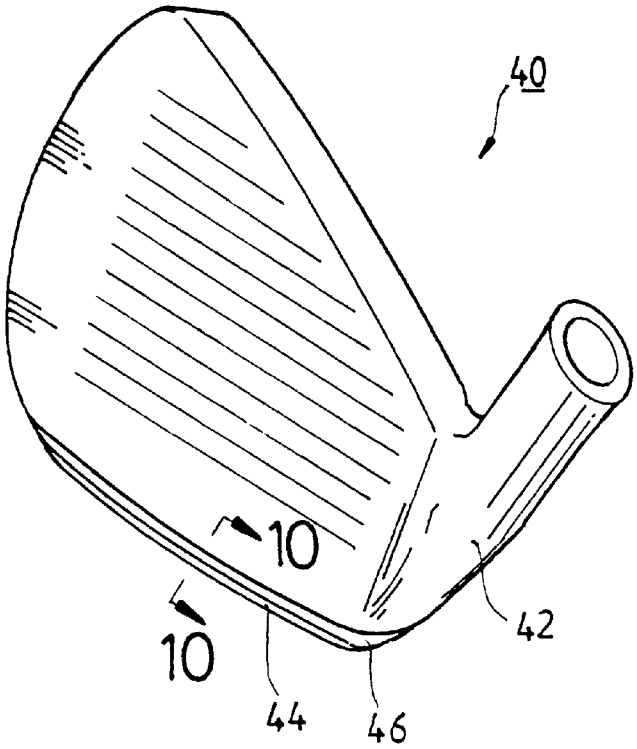
FIG. 9 is a perspective view of a third embodiment of the present invention.
Figure 10:
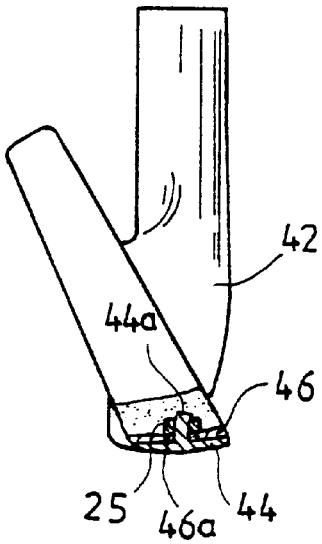
FIG. 10 is a partial sectional view along line 9—9 in FIG. 8.
Figure 11:
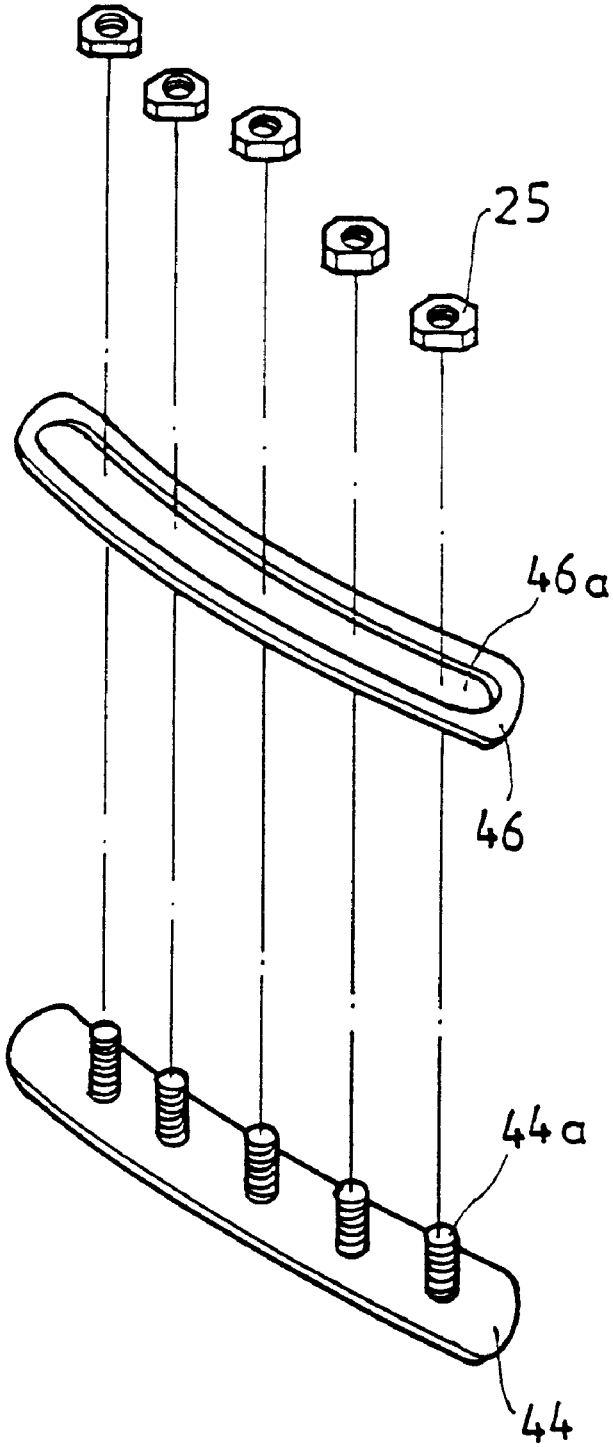
FIG. 11 is a perspective view showing the striking faceplate and the balancing weight body of the third embodiment of the present invention.

FIG. 9 and FIG. 10 illustrate various views of an iron gulf club head 40 according to the third embodiment of the present invention which generally comprises a body member 42, a decorative plate 44 having at least a fastening rod such as bolt 44*a*, at least a fastener such as nut 25 and at least a balancing weight body 46 having a slot 46*a* (referring to FIG. 11) defined therein. The decorative plate 44 is disposed in the sole section of the body member 42, and the balancing weight body 46 is disposed between the body member 44 and the decorative plate 44. The bolt 44*a* of the decorative plate 44 extends through the slot 46*a* which, in turn, is fastened by the nut 25 such that the balancing weight body 46 and the decorative plate 44 can be joined together.

The procedure for manufacturing the iron gulf club head 40 according to the third embodiment of the present invention is similar to that of the putter gulf club head 20 except the contour of molds is complementary to that of the iron gulf club head 40. During the molding process, the molten metal can flow into the slot 46*a* of the balancing weight body 46; hence, after cooling, the metal can fill the slot 46*a* and jam between the nut 25 and the decorative plate 44 (referring to FIG. 10) such that the assembled decorative plate 44 and balancing weight body 46 can be secured to the body member 42. In addition, the body member 42 can be assembled with a shaft at its neck portion to form a golf club.

It will be understood that the decorative plate can be designed as various shape such as squareness, roundness or diamond only as long as that matches the overall shape of the molded golf club head. In addition, the faceplate and/or the balancing weight body can be made of alloy of different color which can be displayed on the surface of the body member, thereby creating the visual variety in color decoration. According to the embodiments of the present invention, the faceplate and the balancing weight body are integrally formed within the golf club head, thereby reducing the possibility of disengagement even after a term of use.

Although the invention has been explained in relation to its preferred embodiment, it is to be understood that many other possible modifications and variations can be made without departing from the spirit and scope of the invention as hereinafter claimed.

What is claimed is:

1. A golf club head comprising:

a body member having a face section, a sole section and a neck section;

a faceplate having at least a fastening rod extending outwardly therefrom;

at least a balancing weight body disposed between the body member and the faceplate, the balancing weight body having a slot defined therein for receiving the fastening rod of the faceplate; and at least a fastener fastening onto the fastening rod for fastening the balancing weight body and the faceplate together;

wherein the faceplate and the balancing weight body are integrally formed with the body member.

2. The golf club head as claimed in claim 1, wherein the faceplate is disposed at the face section of the body member as a striking faceplate.

3. The golf club head as claimed in claim 1, wherein the faceplate is disposed at the sole section of the body member as a decorative plate.

4. The golf club head as claimed in claim 3, wherein the decorative plate is flush with the surface of the body member.

5. A golf club comprising:

a body member having a face section, a sole section and a neck section;

a shaft disposed at the neck section of the body member;

a faceplate having at least a fastening rod extending outwardly therefrom;

at least a balancing weight body disposed between the body member and the faceplate, the balancing weight body having a slot defined therein for receiving the fastening rod of the faceplate; and at least a fastener fastening onto the fastening rod for fastening the balancing weight body and the faceplate together;

wherein the faceplate and the balancing weight body are integrally formed with the body member.

6. The golf club as claimed in claim 5, wherein the faceplate is disposed at the face section of the body member as a striking faceplate.

7. The golf club as claimed in claim 5, wherein the faceplate is disposed at the sole section of the body member as a decorative plate.

8. The golf club as claimed in claim 7, wherein the decorative plate is flush with the surface of the body member.

* * * * *